US005174131A

United States Patent [19]

Cottenceau et al.

[11] Patent Number: 5,174,131

[45] Date of Patent: Dec. 29, 1992

[54] KNITTING MACHINE WITH PATTERNING ARRANGEMENT

[75] Inventors: Rémi Cottenceau, Viry, France; Ernst-Dieter Plath, Albstadt, Fed. Rep. of Germany

[73] Assignee: SIPRA Patententwicklungs-und Beteiligungsgesellschaft mbH, Albstadt, Fed. Rep. of Germany

[21] Appl. No.: 664,409

[22] Filed: Mar. 4, 1991

[30] Foreign Application Priority Data

Mar. 8, 1990 [DE] Fed. Rep. of Germany ..... 4007253

[51] Int. Cl.[5] ..... D04B 9/38

[52] U.S. Cl. ..... 66/25; 66/219; 66/222

[58] Field of Search ..... 66/25, 75.1, 219, 220, 66/222

[56] References Cited

U.S. PATENT DOCUMENTS

| | | | |
|---|---|---|---|
| 3,464,234 | 9/1969 | Carrotte | 66/25 |
| 3,620,047 | 11/1971 | Paepke | 66/25 |
| 3,930,383 | 1/1976 | Nuber | 66/25 |
| 3,971,233 | 7/1976 | Amaya et al. | 66/220 |
| 3,972,206 | 8/1976 | Mureso | 66/220 X |
| 4,584,851 | 4/1986 | Plath | 66/104 |
| 4,827,740 | 5/1989 | Cottenceau et al. | 66/75.1 |
| 4,875,347 | 10/1989 | Vermot-Gaud et al. | 66/219 |
| 4,901,541 | 2/1990 | Taki et al. | 66/25 |

FOREIGN PATENT DOCUMENTS

| | | | |
|---|---|---|---|
| 0319007 | 12/1988 | European Pat. Off. . | |
| 1816864 | 7/1970 | Fed. Rep. of Germany . | |
| 2000578 | 7/1970 | Fed. Rep. of Germany . | |
| 1952827 | 7/1971 | Fed. Rep. of Germany . | |
| 2226763 | 12/1972 | Fed. Rep. of Germany | 66/220 |
| 2453275 | 5/1975 | Fed. Rep. of Germany | 66/220 |
| 3537679 | 4/1987 | Fed. Rep. of Germany . | |
| 3739924 | 2/1989 | Fed. Rep. of Germany . | |

*Primary Examiner*—Werner H. Schroeder
*Assistant Examiner*—John J. Calvert
*Attorney, Agent, or Firm*—Michael J. Striker

[57] ABSTRACT

A knitting machine has a bed, knitting implements which are mounted displaceably in the bed and which each have at least an operating and a pivotably first control butt, and at least one patterning arrangement which has a cam portion intended for guiding the butts, with at least one respective non-knitting, tuck and knitting track formed by cam member, and a selector intended for pivoting the control butts, by means of which the butts are distributed to a respective one of said tracks. The selector has a first control unit for controlling selected knitting implements into the non-knitting track and a second control unit for selectively distributing the other knitting implements to the tuck or knitting track.

21 Claims, 6 Drawing Sheets

KNITTING MACHINE WITH PATTERNING ARRANGEMENT

BACKGROUND OF THE INVENTION

The present invention relates to a knitting machine which has a bed with knitting implements mounted displaceably therein and each having at least one operating butt and at least one first pivotable control butt, and a patterning arrangement which includes a cam and a selector means. The cam includes knitting, tuck and non-knitting tracks for the operating and control butts. The tracks are formed by cam members disposed in superposed relationship. The selector means includes a first and a second control means.

Numerous patterning devices are already known for carrying out what is known as the three-way procedure, that is to say any desired selection of all knitting implements for knitting, tuck and non-knitting on a knitting system. The patterning devices essentially comprise cam members forming knitting, tuck and non-knitting tracks and mechanical, electronic or electromagnetic control means, by means of which the knitting implements are distributed to those tracks.

A known knitting machine (German laid-open application (DE-OS) Nos 19 52 827 and 35 37 679) is not very suitable for very high-speed knitting machines and in particular high-output circular knitting machines. In addition it makes it impossible to provide for continuous positive guidance of all the knitting implements involved and therefore promotes the occurrence of damage caused by the uncontrollable impingement of the butts on projecting edges of the cam members.

Another known patterning arrangement which is suitable for the three-way procedure (German laid-open application (DE-OS) No 37 39 924), provides that the width of the system is almost doubled, and the knitting implements cannot be positively guided.

Finally it is already known (U.S. Pat. No. 4,827,740) to carry out the three-way procedure with knitting needles which are practically continuously positively guided but which must have an operating butt and four pivotable control butts. That means that the knitting needles are of a comparatively great overall length and are not suitable as rib needles for circular knitting machines.

SUMMARY OF THE INVENTION

In comparison therewith it is an object of this invention to design the knitting machine set forth above such that the three-way technique can be carried out without a substantial increase in the width of a knitting system in comparison with the usual two-way technique.

A further object of this invention is to carry out the three-way technique with knitting implements which are such short that they are also suitable for rib plates or dials.

Yet another object of this invention is to make it possible for the knitting implements to be continuously positively guided.

According to the invention the cam includes a first cam member which leads into the tuck position and includes a first raising portion co-operating with the operating butts and a second cam member which leads into the knitting position and includes a second raising portion which is substantially parallel to the first raising portion and which co-operates with the first control butts. The second control means is disposed in the region of the second raising portion.

The invention provides the advantage that the control butts are already subjected to a second selection operation during the upward movement of the knitting implements into the tuck position and not just after attaining the tuck position so that there is practically no need for the width of the system to be increased. Another advantageous consideration is that in principle only a single pivotable control butt is required and therefore the knitting implements can also be of the short overall length required for them to be used in a rib plate even if the knitting implements are continuously positively guided.

The present invention both as to its construction so to its mode of operation, together with additional objects and advantages thereof, will be best understood from the following detailed description of the preferred embodiments when read with reference to the accompanying drawings.

DETAILED DESCRIPTION OF THE PREFERRED EMBODIMENTS

Figure 1:
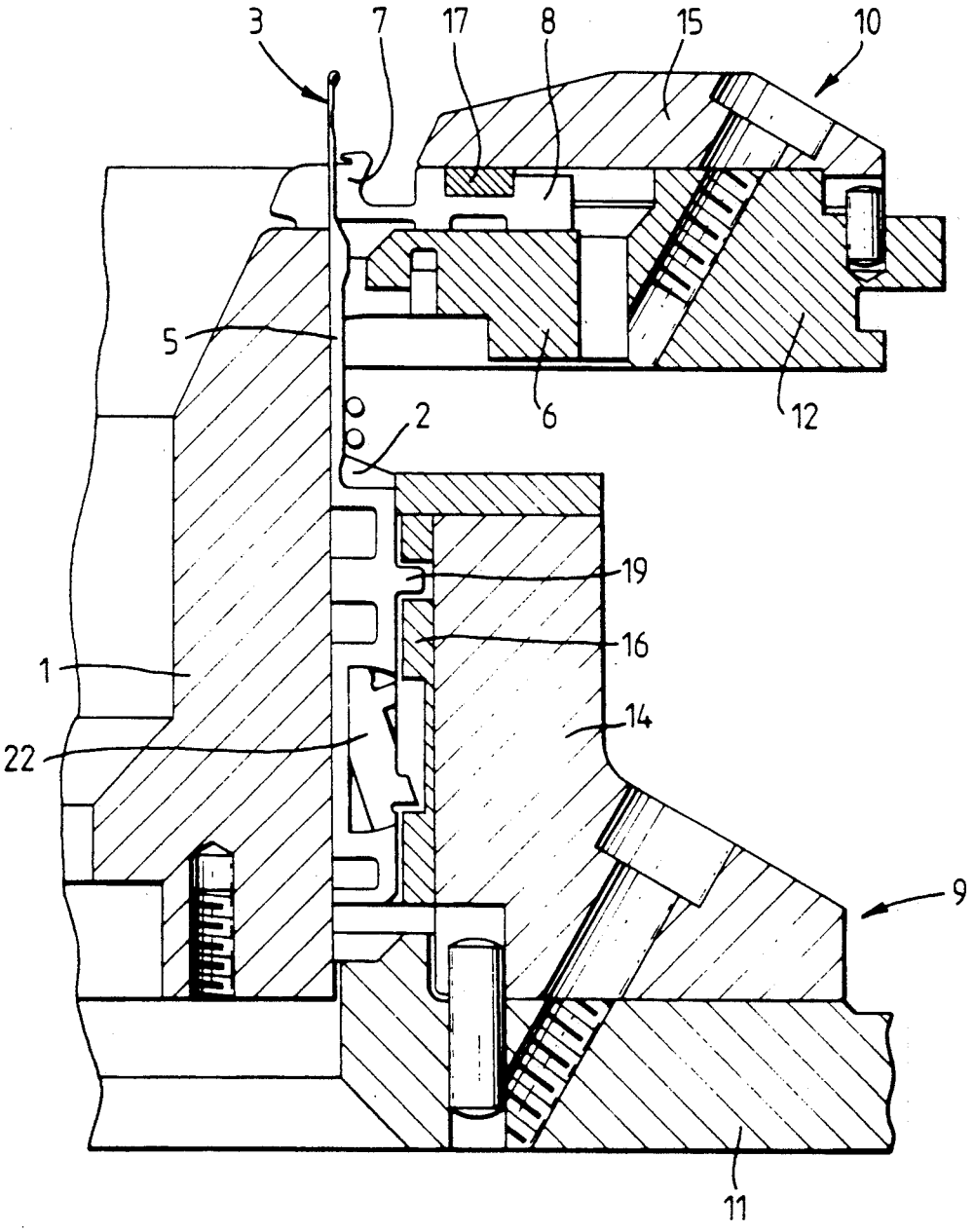
FIG. 1 is a diagrammatic view in vertical section through a circular knitting machine according to the invention.

FIG. 1 shows the details of a circular knitting machine which are necessary to understand the invention, namely a first bed 1 in the form of a needle cylinder with vertically extending lands 2 between which knitting implements 3, in this case knitting needles in the form of conventional latch needles, are slidably mounted, each needle having a shank or stem 5. Arranged above the first bed 1 is a second bed 6 in the form of a sinker ring which has radially extending lands between which further knitting implements 7, in this case sinkers, with butts 8, are slidably mounted. The knitting implements 3, 7 are controlled by cams 9 and 10 which each comprise a cam plate 11 and 12, at least one carrier 14 and 15 respectively secured thereto and cam members 16 and 17 respectively mounted thereon, which act on the butts of the knitting implements 3, 7. In that connection the beds 1, 6 and cams 9, 10 can be moved relative to each other in the usual way while, depending on the cam members used, at the same time the knitting implements 3, 7 can be raised or lowered parallel to their longitudinal direction or can be held in the non-knitting or laying position.

Figure 2:
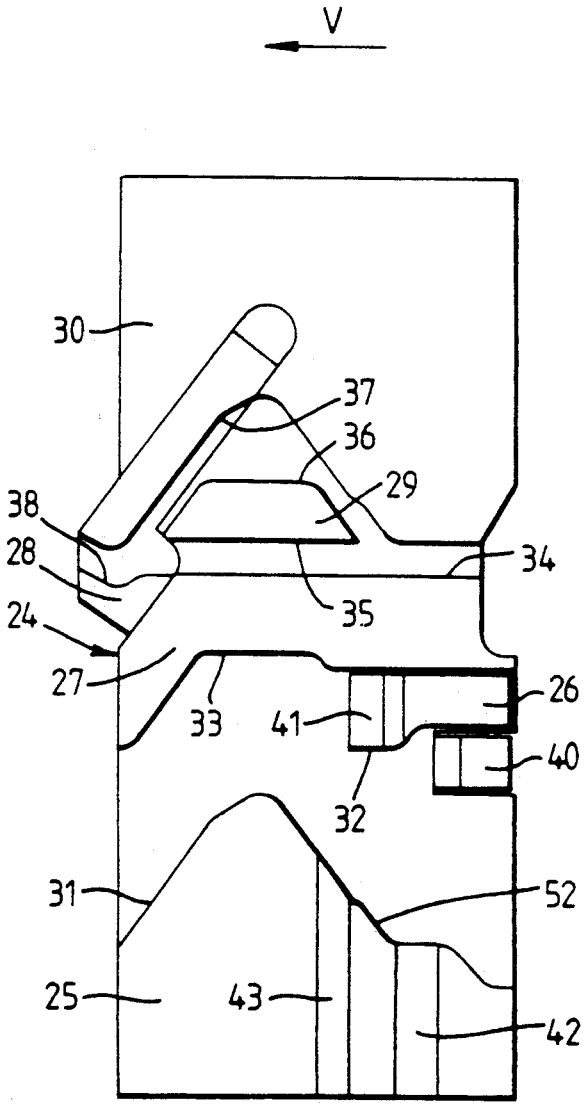
FIGS. 2 and 2*a* is a diagrammatic front view of a cam portion of the circular knitting machine shown in FIG. 1.
Figure 2A:
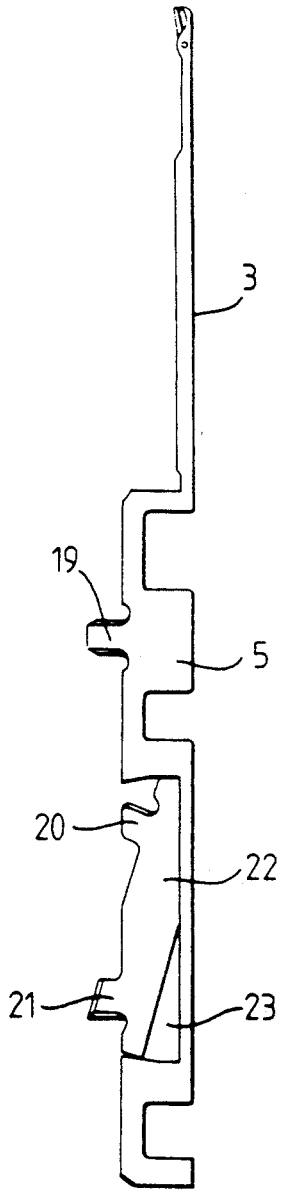

As is more clearly apparent from FIG. 2. the kitting implements 3 each have an operating butt 19 which is preferably rigidly secured to the stem 5 and at least one control butt which is pivotably mounted on the stem 5. The illustrated embodiment has two pivotable control butts 20 and 21 which are provided on a common selection element 22 which is mounted in a recess 23 rotatably or pivotably but preferably axially immovably with respect to the stem 5. The selection element 22 can be pivoted by means of electromagnetic or any other control means in such a way that either the first control butt 21 projects beyond the front side of the stem 2 and the second control butt 20 is pivoted back behind said front side, or vice-versa (see also FIGS. 4 and 5).

Knitting machines, cam assemblies, knitting implements 3 of the described kind and the selection and control thereof are basically known to the man skilled in the art from U.S. Pat. No. 4,827,740 and EP-Al-0 319 007 to which reference is hereby expressly directed for the avoidance of repetition. and they therefore do not need to be described in greater detail herein.

As is further apparent from FIG. 2. a patterning arrangement which extends over the width of a knitting system for carrying out the three-way procedure comprises a cam assembly 24 with a plurality of cam members 25 to 30 which are arranged one above the other. In that connection a lower cam member 25 defines with its top side 31 a knitting track for the control butts 21. The underside 32 of a central cam member 26 substantially defines a non-knitting or laying track for the control butts 20. The underside 33 of a defining member 27 essentially forms a tuck track for the control butts 20. The top side 34 of the defining member 27 essentially defines a non-knitting or laying track for the operating butts 19. The top side 36 of a separating cam member 29 essentially defines a tuck track for the operating butts 19. The underside 37 of an upper cam member 30 defines a knitting track for the operating butts 19. Finally a counter-cam member 28 can also act with its top side 38 on the operating butts 19. In that connection the relative movement between the cams 10, 11 and the beds 1, 6 (FIG. 1), as indicated by an arrow v (FIGS. 2 to 5) is so selected that the knitting implements 3 pass through the specified tracks from right to left.

The patterning arrangement shown in FIG. 2 also includes two positioning cams 40 and 41 and two control means 42, 43. In that connection the positioning cams 40 and 41 serve to act on the control butts 20 and to pivot all projecting control butts 20 of the knitting implements 3 moving therepast into the position shown in FIG. 2 so that when the knitting implements 3 move past the control means 42, 43, all control butts 21 project beyond the front side of the needle stems 5, as shown in FIG. 2. On the other hand the control means 42 and 43 serve to leave the control butts 21 of selected knitting implements 3 in the position shown in FIG. 2 and to pivot the control butts 21 of all other knitting implements 3 inwardly so that the control butts 20 project beyond the front sides of the needle stems 5. In that respect the positioning cams 40, 41 and control means 42, 43 are displaced relative to each other in the direction of the arrow v in such a way that firstly the positioning cam 40, then the control means 42, then the positioning cam 41 and finally the control means 43 comes to act at any knitting implement 3.

Figure 3:
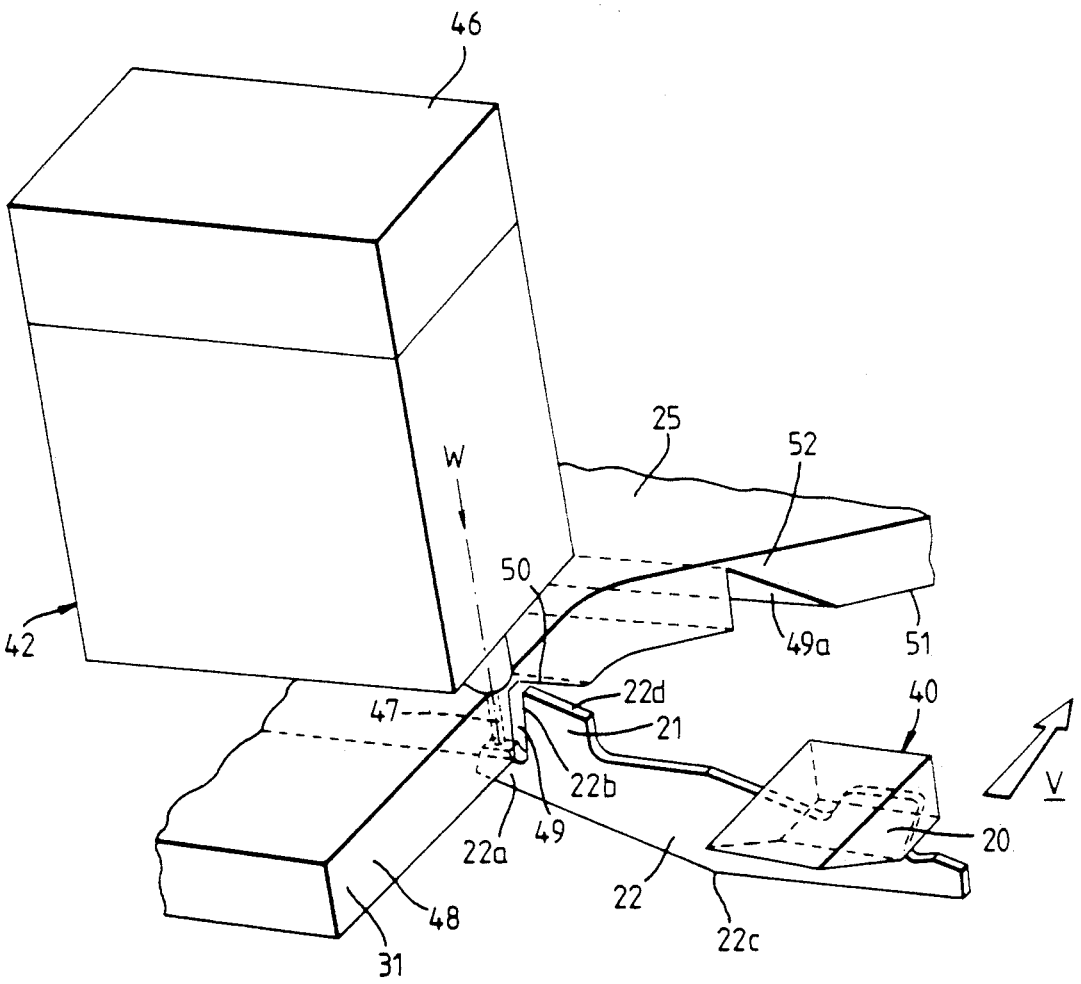
FIG. 3 is a perspective diagrammatic view of the parts of the circular knitting machine shown in FIG. 1, which are essential for selection of the knitting implements.

As FIG. 3 shows. the pivotal movement of the selection element 22 is desirably effected in known manner by means of a control needle 47 which can be driven by an electromagnetic drive 46 and which transmits the motional energy obtained from the drive 46 in the form of a resilient thrust on to a lower end portion 22*a* of the respective selection element 22 (EP-Al-0 319 007). For that purpose, the lower cam member 25 has a gap 49 in a flat portion 48 of its top side 31, which portion 48 guides a lower edge 22*b* of the control butt 21. Selection occurs when the control butt 21 is disposed opposite the gap 49 upon transportation in the direction of the arrow v. If at that moment the control needle 47 is advanced in the direction of an arrow w, that results in a pivotal movement of the selection element 22 about a pivot edge 22*c* whereby a small part of the front edge 22*d* of the control butt 21 passes into the gap 49.

Upon further movement of the selection element 22 in the direction of the arrow v, the front edge 22*d* therefore passes on to an inclined surface 50 which adjoins the rear end of the gap 49 whereby the selection element 22 is pivoted further about the pivot edge 22*c* until the butt 21 slides along the front surface 51 of the cam member 25 and thereby practically disappears in the stem 5 of the knitting implement 3 while the control butt 20 is pivoted fully out. Unintentional return pivotal movement of the selection element 22 is prevented by the front surface 51. If on the other hand the control needle 47 is not pushed forwardly at the moment at which the control butt 21 passes the gap 49, the control butt 21 then remains in the position shown in FIGS. 2 and 3. Upon further movement of the selection element 22 in the direction of the arrow v therefore its lower edge 22*b* passes on to a raising portion 52, which follows the gap 49. of the cam member 25.

Figure 4B:
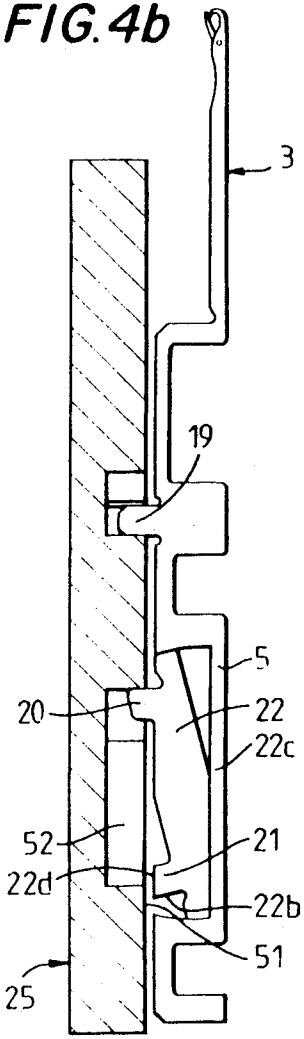
FIGS. 4, 4*a*, 4*b* and 5, 5*a*, 5*b* are diagrammatic front views of a patterning arrangement which is extended over a system width and the associated functional members which are shown in vertical section, FIGS. 4, 4*a*, 4*b* diagrammatically indicating the knitting implements selected for passing through a non-knitting and a knitting track and FIGS. 5, 5*a*, 5*b* diagrammatically indicating the other knitting implements selected for passing through a tuck track.
Figure 4A:
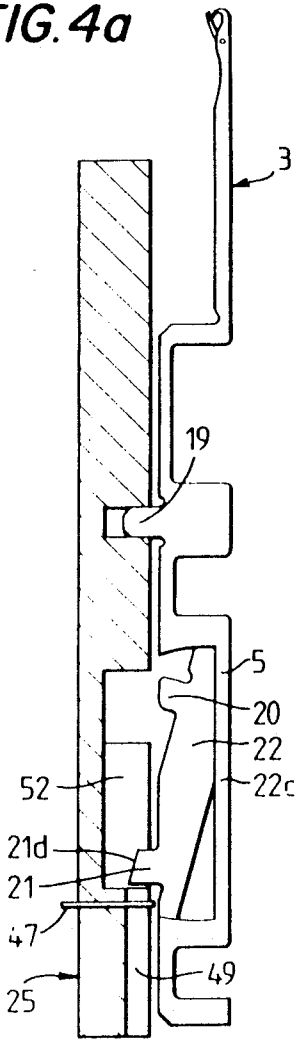
Figure 4:
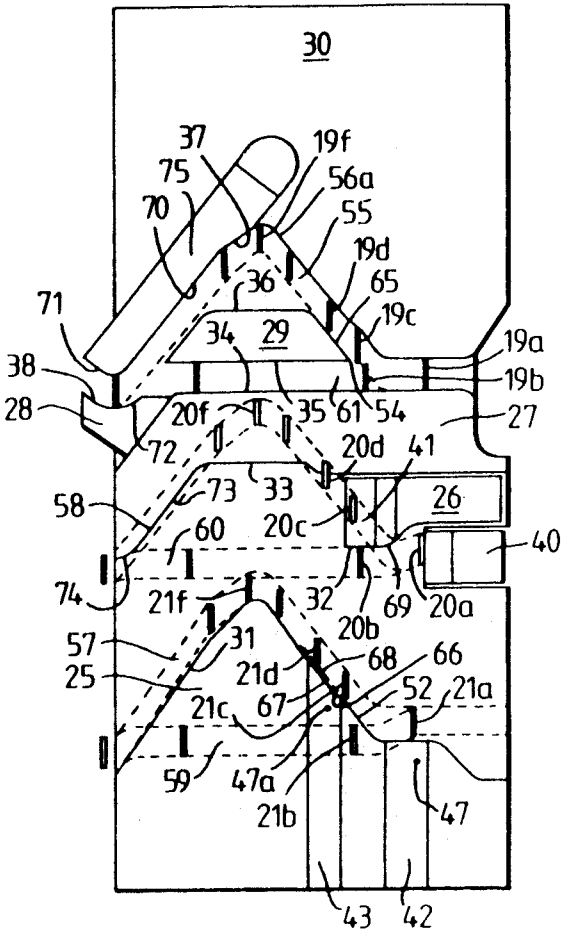
Figure 5B:
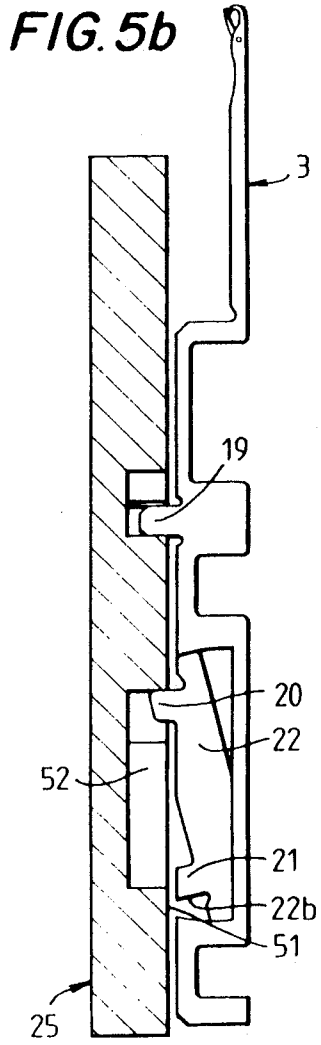
Figure 5A:
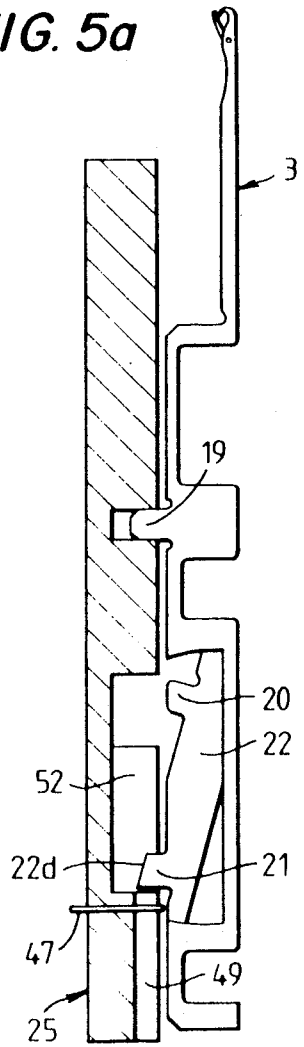
Figure 5:
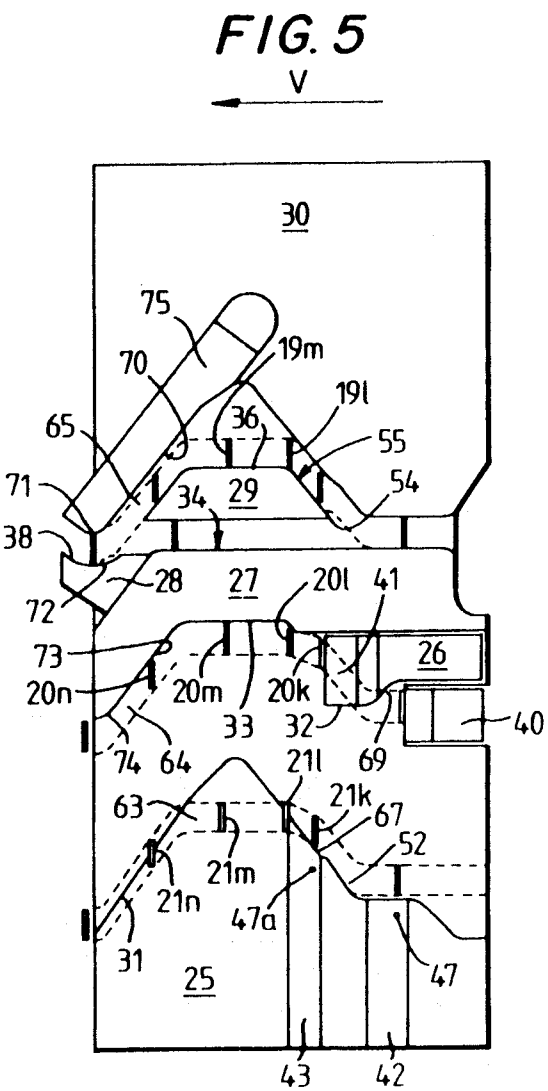

The mode of operation, the control options and the advantages of the invention are particularly apparent from FIGS. 4 and 5 in which the knitting implements 3 and cam members 25 to 30 are shown on an exaggeratedly large scale in order to make it easier to understand the invention. In that respect, in the front views of the cam portions shown in FIGS. 4 and 5, the butts which are shown in black throughout, for example 19*a*, 20*b* and 21*a* (see FIG. 4) are those which project beyond the associated cylinder lands 2 and can be raised and lowered by the cam members. Butts which are only bordered with a black line, for example 20*a* and 21*b* (see FIG. 4) on the other hand are those which are fully lowered into the associated stem 5 and which can therefore be neither raised nor lowered by the cam members.

As shown in FIGS. 4 and 5, upon movement of the knitting implements 3 in the direction indicated by the arrow v, the positioning cam 40 firstly acts on the butts 20 so that they are pivoted into that position which in each case is shown in the lefthand one of the two side views of the knitting implement 3 shown in FIGS. 4 and 5. The projecting control butts 21 are then pivoted or not pivoted in accordance with the pattern by means of the first control means 42 so that the unpivoted control butts (for example 21*c*) pass on to the raising portion 52 while the pivoted control butts (for example 21*b*) are guided on to the front side 51 of the cam member 25.

As in the illustrated embodiment the selection elements 22 are admittedly mounted rotatably in the stems 5 but are axially immovable, the operating butts 19 are also raised as soon as the control butts 21 pass on to the raising portion 52. In that connection a separating tip 54 of the separating cam member 29 may easily be so arranged as certainly to avoid impact of the operating butts 19, for example by the drive portion 52 beginning somewhat earlier than a raising portion 55, acting on the operating butts 19, of the separating cam member 29, which extends substantially parallel to the raising portion 52 but leads only into the tuck position. The operating butts 19 (for example 19*c*) are therefore raised without the risk of breakage by way of the separating tip 54 and then are raised into the knitting position together with the knitting implements 3 and the associated control butts 21 (for example 21*f*) by the raising portion 52 of the lower cam member 25 so that the butts 19, 21 are each guided in a respective knitting track 56, 57 shown in broken lines. In that situation the associated control butts 20 (for example 20*f*) slide on the front side of the cam members 26, 27 along a knitting track 58.

On the other hand the control butts 21 (for example 21*b*) which are pivoted by the control means 42 pass on the front side of the cam member 25 into a non-knitting track 59. At the same time the projecting control butts 20 (for example 20*b*) and operating butts 19 (for example 19*b*) are guided in corresponding non-knitting tracks 60, 61.

If a knitting implement 3 is to be selected for the tuck position, the control means 43 is activated, which is provided with a control needle 47*a* corresponding to the control needle 47, and those control butts 21 (for example 211, FIG. 5) which are only to be raised into the tuck position are pivoted away from the raising portion 52 until they are fully sunk in the stem 5, corresponding to the side view of the knitting implement 3 which is shown entirely at the right in FIG. 5. The control butts therefore pass on to the front surface 51 of the cam member 25 and are not raised further but are guided in a tuck track 63 as shown in FIG. 5. The associated control butts 20 (for example 201) and operating butts 19 (for example 191) are similarly guided in tuck tracks 64, 65 which are in part identical in their rising portions to the knitting tracks 56 and 58. The second positioning cam 41 ensures in that respect that the control butts 21 are precisely positioned relative to the second control means 43 shortly before the second control means 43 is reached, and do not assume an undesired pivotal position as a result of centrifugal movements or the like.

Selection of the control butts 21 by the control means 43 is effected as shown in FIGS. 4 and 5 at a location which is disposed in a central part of the raising portion 52. That gives the substantial advantage that there is no need for an increase in the width of the system and the raising portion 52 can extend straight throughout. A disadvantage in that respect is the fact that selection is effected while the portion 52 is acting on the control butts 21 in order to lift the knitting implements 3 into the knitting position because in that way considerable frictional forces have to be overcome. In accordance with the invention therefore the patterning arrangement is provided with a means for relieving the load on the control butts 21 in the region of the raising portion 52 so that during the selection operation they are subjected to practically no or only very slight frictional forces.

In a practical embodiment in respect of said means, it is provided that the spacing between the two raising portions 52 and 55 which extend substantially parallel is selected to be slightly greater, approximately from the location where the second control means 43 begins to approximately that location at which the portion 55 ends, than the spacing of the bottom edges of the operating butts 19 and control butts 21, in order momentarily to relieve the load on the control butts 21 (for example 21*d*) and in that region to provide that the operating butts 19 (for example 19*d*) slide on and are guided by the raising portion 55. As shown in FIG. 4, that is achieved for example by the raising portion 52 being displaced towards the left in parallel relationship by for example about 0.3 mm at a location 66 (butt 21*c*) in order to provide a recess 67, a free space or the like. The control butts 21 therefore firstly slide on the raising portion 52 and are lifted thereby. As the operating butts 19 are certainly lifted by way of the separating tip 54, for example at a location 66, in contrast the control butts 21 are relieved of load while at the same time the operating butts 19 are put on to the raising portion 55 and are then lifted by same. The lower edges of the control butts 21 (for example 21*d* in FIG. 4) are therefore freely floatingly guided at a small distance closely above the raising portion 52 on a path of movement shown in broken lines at 68 so that they suffer from practically no friction and can be selected by the control means 43 practically without the application of force. In that situation the butts 19 which slide on the raising portion 55 prevent the control butts 21 from undesirably dropping out into the raising portion 52 in the region of the recess 67.

At the end of the raising portion 55 the operating butts 19 have a tendency to run on to the substantially horizontal part of the top side 36 of the separating cam member 29. Since as a result of that the control butts 21 move towards the displaced part of the raising portion 52 and are gradually set down thereon, in accordance with the invention at that time there is a new change in the way in which the knitting implements 3 are guided, in that the raising portion 52 is brought back into operation again in order to move the control butts 21 (for example 21*f* in FIG. 4) and therewith also the operating butts 19 (for example 19*f* in FIG. 4) and the knitting implements 3 definitively into the highest raised position. In this last part of the lifting movement therefore the upper edges of the operating butts 19 are guided substantially along a path indicated in broken line at 56*a* (FIG. 4).

At the beginning of the recess 67 the other control butts 20 are firstly still guided on the front side of the cam member 26. Shortly thereafter however they slide in a freely floating mode in an intermediate space between the two cam members 26 and 27 (for example 20*k* in FIG. 5) so that, upon passing the recess 67, the associated selection elements can be freely pivoted without substantial frictional forces or the like having to be overcome. In that situation the second positioning cam 41 ensures that said selection elements 22 cannot pivot unintentionally prior to the second control means 43 being reached. In other respects the selection operation is effected by means of the second control means 43 similarly to FIG. 3, with an associated gap 49*a* being arranged in a corresponding part of the raising portion 52.

The described arrangement ensures that the three-way procedure can be carried into effect without an increase in the width of the system. The three-way procedure can also be performed without the knitting implement 3 having to be provided with additional control or operating butts, in comparison with a two-way procedure (for example knitting/non-knitting), so that it is also possible to use extremely short knitting implements 3, as may be desired for example for controlling rib needles.

Alternatively it is possible to design the recess 67 in such a way that the part of the raising portion 52 which is disposed downstream thereof initially rises somewhat more sharply than normal and thus approaches the line 68. The only difference would be that the control butts reach their highest position at a location which is substantially in line with the line 68 while in the embodiment first described above the highest position is reached at a time which is later, by the extent of the displacement, in this case for example about 0.3 mm.

It is also possible to envisage further embodiments of the means for relieving the load on the control butts 21. In particular, instead of the recess 67, it would be possible to provide a corresponding projection in the raising portion 55, which, when the operating butts run thereonto, causes the control butts 21 to be lifted off the raising portion 52 at the same time. At any event provided within the rising part of the knitting track 57 is a region in which the control butts 21 which are subjected to selection are relieved of load.

The described patterning arrangement also makes it possible in accordance with the invention to provide for continuous positive guidance of the knitting implements. For that purpose the patterning arrangement is of the following configuration.

Guidance of the knitting implements 3 in the region of the raising portions of the various cam members will first be described.

As FIG. 4 shows, the knitting implements 3 which are selected for non-knitting are guided with their operating butts 19 on the top side 34 of the defining member 27 and with their control butts 20 at the underside 32 of the central cam member 26, wherein the underside 32 additionally has an inclined draw-down portion 69 which comes into operation downstream of the first control means 42 and which certainly prevents impingement of the associated operating butts 19 against the separating tip 54 (for example 19*b* and 20*b* in FIG. 4).

The knitting implements 3 selected for knitting purposes are guided during the raising operation in the above-described manner on the one hand by the raising portions 52 and 55 respectively and on the other hand by the rising part of the underside 37 of the upper cam member 30.

During the raising phase the knitting implements 3 selected for the tuck operation (see FIG. 5) are initially guided just like the knitting implements 3 which are selected for knitting purposes and are therefore securely guided past the separating tip 54. As soon as the second selection operation has taken place, as can be seen in FIG. 5 by the transfer of the control butts 20, 21 for example from the position 20*k*, 21*k* into the position 201, 211, the now projecting control butt 20 (for example 20*l*, 20*m*) is in contrast guided by the underside 33 of the defining cam member 27 and at the same time the associated operating butt 19 (for example 19*l*, 19*m*) is guided by the top side 36 of the separating cam member 29, thereby ensuring even at high speeds of operation that the operating butts 19 could not be raised beyond the top side 36.

In comparison, guidance for the knitting implements in the region of the draw-down portions of the various cam members is as follows.

The knitting implements 3 coming from the knitting position are firstly transferred by way of a gentle arc in the underside 37 of the cam member 30 on to the draw-down portion 70 thereof which at its lower end has a stitch-forming edge 71 for establishing the stitch length. In that situation, the knitting implements are prevented from dropping out, which could be connected to dropped stitches, by the falling part of the top edge 36 of the separating cam member 29 and/or by the falling part of the top side 31 of the lower cam member 25 while at the same time an inclined run-in portion 72 in the top side 38 of the counter-cam member 28 serves to catch the operating butts 19 or cause them to impinge softly on the counter-cam member 28.

The control butts 20 of those knitting implements which were raised into the tuck position are taken over (for example 20*n*) in the drawing-down operation by a drawing-down portion 73 which preferably becomes operative somewhat before the drawing-down portion 70, at the underside 33 of the defining member 27, and are then progressively moved towards the drawing-down portion 70 or the stitch-forming edge 71 of the cam member 30. That is achieved by an inclined run-off portion 74 which is provided at the end of the underside 33 of the defining member 27 and which extends at a shallow angle. Thereupon the operating butts 19 of the knitting implements 3 coming from the tuck position are gently put on to the counter-cam member 28 by means of the inclined run-in portion 72, as is also the case in regard to the needles coming from the knitting position. The drawing-down portion 70 can be adapted to be adjustable, if required, for adjusting the stitch length. The knitting implements are once again prevented from dropping out by means of the top side 36 of the separating cam member 29.

The non-raised knitting implements 3 finally pass on to the inclined run-off portion 74 (FIG. 4) at the end of the non-knitting track 60, with their control butts 20, and are progressively moved by the portion 74 towards the tracks of the raised knitting implements 3, that is to say with the operating butts 19, gently towards the drawing-down portion 70 or the stitch-forming edge 71. By virtue of that arrangement, on the one hand, the drawing-down depth of all knitting implements is established, by virtue of the stitch-forming edge 71, while on the other hand that arrangement eliminates severe impacts against the stitch-forming edge 71 or corresponding points on other cam members and in particular the counter-cam member 28. The knitting implements 3 are therefore constantly positively guided by two butts and the associated cam members.

As finally the knitting implements 3 are also positively guided in the region of the control means 42 and 43 or the recess 67 by the cam members 27, 30 and 29, 30 respectively which act on the operating butts 19 (for example 19*a* and 19*d* respectively), it is practically not possible to leave the position selected for any knitting implement 3 or any butt 19, 20 or 21 respectively. Therefore no part of the knitting implement 3 needs to be provided or mounted with friction, which on the one hand permits an optimum reduction in the forces required for the selection operations while on the other hand permitting movements with the generation of a small amount of heat.

The drawing-down portion 70 is desirably secured to a slider 75 which also carries the cam member 28, is mounted in or on the cam member 30, and can be displaced parallel to the drawing-down portion 70 in order thereby to permit adjustment of the stitch length.

Figure 6:
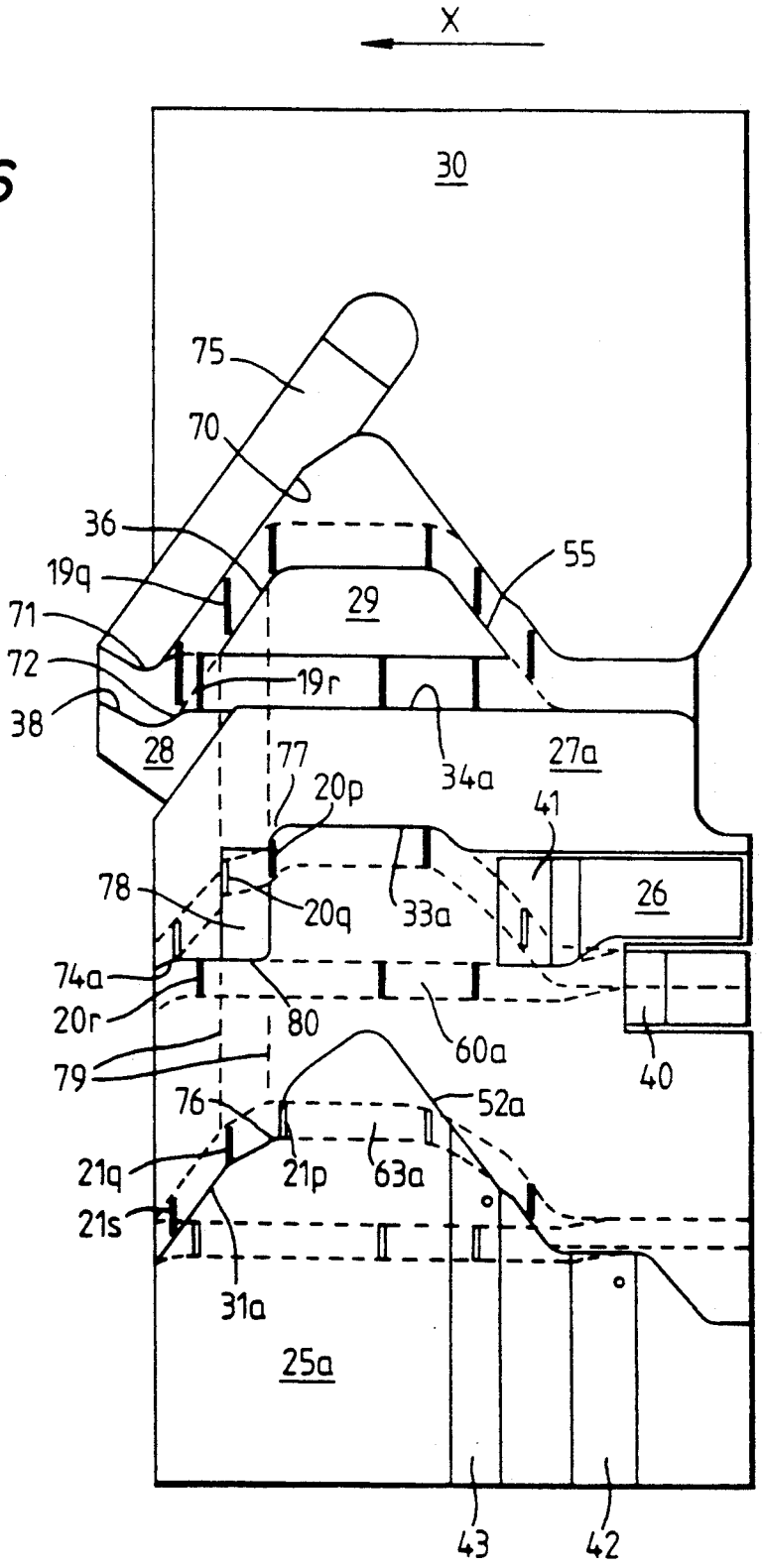
FIG. 6 is a view corresponding to that shown in FIGS. 4 and 5 but on a larger scale, of a second embodiment of the patterning arrangement, with the vertical sections being omitted.

In the embodiment shown in FIG. 6 components which are identical to the components of FIGS. 4, 5 are identified by the same reference numerals and which. This embodiment permits the knitting implements 3 to be positively guided in a different manner, and is considered to be the best. The knitting implements are not shown once again in vertical section, for the sake of simplicity.

Instead of the cam members 25, 27, this arrangement has cam members 25*a*, 27*a*. The cam member 25*a* corresponds in the rising portion to the cam member 25 while additionally arranged in the top side 31*a* of its falling portion is a recess 76 at a location where the tuck track 63*a* changes from its straight part into the falling part. The defining member 27*a*, in its part at the right in FIG. 6, corresponds to the defining member 27 whereas its underside 33*a*, in the part at the left in FIG. 6 and in the direction of the movement of the knitting implements (arrow x), firstly has a slightly downwardly curved portion 77, adjoining same a third positioning cam 78 and adjoining same a portion having an inclined run-off portion 74*a*.

The positioning cam 78 is like the positioning cams 40, 41 and is of such a configuration that it acts on projecting control butts 20 of the knitting implements 3 and pivots them until they are sunk fully into the stems of the knitting implements 3 and instead the first control butts 21 project forwardly. In that respect the relative position of the positioning cam 78 is so selected that it comes into operation shortly before the end of the separating cam member 29 and the pivoting operation is terminated before that end is reached. In addition the recess 76 is disposed at the location of the positioning cam 78, as is clearly shown by broken lines 79 in FIG. 6. In other respects the arrangement and configuration of the cam members 25*a*, 27*a* are so selected as to provide the mode of operation described hereinafter.

In the embodiment shown in FIG. 6, selection of the control butts 20, 21 with the control means 42, 43 and guidance for the knitting implements 3 in the raising phase occur in a similar manner to selection and guidance as described with reference to FIGS. 1 to 5. On the other hand the effect described hereinafter arises in relation to the drawing-down phase.

The operating butts 19 of the knitting implements 3 which are knitting are initially guided after the raising operation to the drawing-down portion 70, in a gentle arc, and are guided between the portion 70 and the top side 36 of the separating cam member 29. Alternatively or in addition and in particular before the beginning of the recess 76, the control butts 21 of those knitting implements 3 can be guided on the top side 31*a* of the cam member 25*a*. In contrast, at the end of the separating cam member 29, only the control butts 21 of those knitting implements 3 provide the positive guidance effect insofar as immediately downstream of the recess 76 they pass on to the top side 31*a* of the cam member 25*a* (for example 21*s* in FIG. 6) until finally the operating butts 19 are taken over by the inclined run-in portion 72.

The knitting implements which are non-knitting are initially guided in a similar manner to FIGS. 4 and 5 between the cam members 27*a* and 29. In contrast, downstream of the end of the defining member 29 on the one hand the operating butt 19 is further supported on the top side 34*a* of the defining member 27*a* while at the same time the control butt 20 (for example 20*r*) of those knitting implements 3 passes on to a bottom edge 80 which is provided at the end of the defining member 27*a* and beneath the positioning cam 78 and which has an inclined run-off portion 74*a* corresponding to the portion 74 shown in FIGS. 4 and 5. That bottom edge 80 provides two substantial advantages. On the one hand a knitting implement 3 which is in the non-knitting position cannot jump up and in so doing, if it is a knitting needle, unintentionally pick up the yarn (not shown) or parts thereof, which would result in undesired tuck stitches. On the other hand the operating butts 19 (for example 19*r*) of the knitting implements which are guided in the non-knitting position are guided to the drawing-down portion 70 at a shallow angle by means of the inclined run-off portion 74*a*, as in the embodiment shown in FIGS. 4 and 5, so that they impact gently against the portion 70. Moreover the counter-cam member 28 which follows the separating cam member 29 prevents the knitting implements from dropping out, irrespective of the stitch length selected in the specific situation involved.

The knitting implements 3 which are raised into the tuck position are intially guided by the operating butts 19 on the top side 36 of the defining member 29 and by the control butts 20 on the underside 33*a* of the defining member 27*a*. In the region of the broken line 79 in FIG. 6, the positive guidance effect is taken over by the drawing-down portion 70 and the top side 36 of the separating cam member 29, with the portion 77 of the defining member 27*a* ensuring a gentle transition for the operating butts 19 on the drawing-down portion 70. At the same time the third positioning cam 78 acts on the control butts 20 of the knitting implements 3 (for example 20*b*) and presses same in the stems thereof while the control butts 21 (for example 21*p*) are pivoted outwardly. At the end of the separating cam member 29 that operation is concluded (see control butts 20*q* and 21*q*) with the result that the outwardly pivoted control butts 21 pass immediately adjoining the gap 76 on to the top side 31*a* of the cam member 25*a* and the knitting implements 3 are now guided between the latter and the drawing-down portion.

A particular advantage of the embodiment which is preferred at the present time, as shown in FIG. 6, is that positive guidance for the knitting implements 3 which are raised into the knitting position or into the tuck position respectively, is substantially identical during the drawing-down phase and is not interrupted at any point, and that the knitting implements 3 which are selected for the non-knitting position are also accurately guided between the end of the separating cam member 29 and the then following part of the drawing-down portion 70.

The invention is not restricted to the described embodiments which can be modified in many ways. That applies for example in regard to the control means which basically could also be replaced by mechanical and electronic but also all other known electromagnetic control means, and the described cam members which could be modified in particular in regard to the positive guidance effect. However it is also possible to envisage knitting implements other than the illustrated knitting implements 3. The knitting implements 3 which in the described embodiment are in the form of latch needless could also be for example in the form of slider needless, pressers, sinkers, plush hooks or the like which are provided alone or in addition to the knitting needless. In addition, instead of selection elements which are mounted rotatably or pivotably in the stems of the knitting implements, it would also be possible to use those which are hingedly connected to the lower end of the stem and which have only one control butt which could also be formed from the lower end of the selection element. The position of the operating butt relative to the control butts is also variable (see in that respect U.S. Pat. No. 4,827,740). Finally the invention may also be used in connection with flat bed knitting machines or those circular knitting machines which have only rib needless or cylinder and rib needles or in which there are cylinder needles and sinkers which perform opposite movements for the purposes of stitch formation (U.S. Pat. No. 4,584,851).

While the invention has been illustrated and described as embodied in a knitting machine suitable for the three-way technique, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A knitting machine, comprising a bed; a plurality of knitting implements mounted displaceably in said bed and each having at least one operating butt and at least one first movable control butt; and a pattering arrangement for being passed by said knitting implements and including a cam and selector means, said cam including cam members defining respective knitting, tuck and non-knitting tracks for each of said operating and control butts, said tracks being disposed in superposed relationship and containing a first tuck track cooperating with said operating butts and having a first raising portion leading into a tuck position and a first knitting track cooperating with said first control butts, having a second raising portion leading into a knitting position and being substantially parallel to said first raising portion, said selector means including first control means and second control means, said first control means serving for selectively guiding said first control butts onto said second raising portion or into said non-knitting track, and said second control means being disposed in a region of said second raising portion and serving for selectively leaving said first control butts on said second raising portion or guiding said first control butts into said tuck track.

2. A knitting machine according to claim 1, wherein said pattering arrangement has means for relieving said first control butts on said second raising portion when said knitting implements pass said second control means.

3. A knitting machine as defined in claim 1; and further comprising selection elements being movably coupled with said to said knitting implements, said first control butts being provided on said selection elements, said selection elements each having a second control butt which is moved back when said first control butt is moved out and moved forward when said first control butt is moved back.

4. A knitting machine as defined in claim 1, wherein said patterning arrangement has a defining member which acts on said second control butts and which fixes a maximum height of a raising movement of said knitting implements when said operating butts are guided into said first tuck track.

5. A knitting machine as defined in claim 1, wherein said cam members are of such a configuration and arrangement that said knitting implements are substantially constantly positively guided when passing said patterning arrangement.

6. A knitting machine as defined in claim 1; and further comprising a separating cam member which is associated with said operating butts and has a separating tip for separation of said knitting implements the butts of which are guided into said non-knitting tracks from other knitting implements, said first raising portion being provided on said separating cam member, said second raising portion beginning upstream of said first raising portion and having such a configuration and arrangement that said operating butts which are not guided into the respective non-knitting track are lifted by means of said first control butts above said separating tip onto said first raising portion.

7. A knitting machine as defined in claim 6, wherein said pattering arrangement includes a central cam member which acts on said second control butts and which prevents said operating butts which are controlled into the respective non-knitting track from impinging against said separating tip.

8. A knitting machine as defined in claim 1, wherein said pattering arrangement comprises a further cam member with a first drawing-down portion which acts on said operating butts and which is provided with a stitch-forming edge for establishing a drawing-down depth of said knitting implements.

9. A knitting machine according to claim 1, wherein said pattering arrangement comprises a further cam member with a first drawing-down portion which acts on said operating butts and which is provided with a stitch-forming edge for establishing a drawing-down depth of said knitting implements, said defining member being provided with a second drawing-down portion which acts on said second control butts and which becomes operative prior to said first drawing-down portion, for controlling a drawing-down of those knitting implements the butts of which are guided into the respective tuck tracks.

10. A knitting machine as defined in claim 8; and further comprising a counter-cam member associated with said stitch-forming edge and having an inclined run-in portion, said run-in portion being designed for gently catching said operating butts which are guided by said first drawing-down portion.

11. A knitting machine as defined in claim 9; and further comprising a counter-cam member associated with said stitch-forming edge and having an inclined run-in portion, said run-in portion being designed for gently catching said operating butts of the knitting implements the second control butts of which are guided by said second drawing-down portion.

12. A knitting machine as defined in claim 11, wherein said second drawing-down portion has an end at which said defining member has an inclined run-off portion, being arranged in a region of said inclined run-in portion and guiding said second control butts which are guided into the respective non-knitting track and into the respective tuck track in such a way that the associated operating butts impinge gently against said first drawing-down portion or said stitch-forming edge.

13. A knitting machine as defined in claim 8, wherein said patterning arrangement has a defining member which acts on said second control butts and which fixes a maximum height of a raising movement of said knitting implements when said operating butts are guided into said first tuck track, said defining member having a positioning cam which is arranged at an end of said separating cam member and which moves said second control butts back and thereby moves said first control butts forward, wherein another of said cam members has a top side substantially extending parallel to said first drawing-down portion, acting on said first control butts and having a recess disposed in a region of said positioning cam, and wherein said knitting implements which butts are raised into said respective tuck positions are positively guided with their operating butts between said first drawing-down portion and said separating cam member during a drawing-down phase until leaving said positioning cam and with their operating butts at said first drawing-down portion and with their first control butts at said top side after leaving said positioning cam.

14. A knitting machine as defined in claim 10, wherein said knitting implements selected for non-knitting are positively guided with their operating butts between said separating cam member and said defining member as far as an end of said separating cam member and thereafter with their operating butts positively on a top side of said defining member or a subsequent counter-cam member and with their second control butts at the bottom edge of said defining member.

15. A knitting machine as defined in claim 1, wherein said knitting implements are latch needles.

16. A knitting machine as defined in claim 1, wherein said bed is a dial and said knitting elements comprise dial needles.

17. A knitting machine, comprising a bed; a plurality of knitting implements mounted displaceably in said bed and each having at least one operating butt and at least one first movable control butt; and a pattering arrangement for being passed by said knitting implements and including a cam and selector means, said cam including cam members defining respective knitting, tuck and non-knitting tracks for each of said operating and control butts, said tracks being disposed in superposed relationship and containing a first tuck track cooperating with said operating butts and having a first raising portion leading into a tuck position and a first knitting track cooperating with said first control butts, having a second raising portion leading into a knitting position and being substantially parallel to said first raising portion, said selector means including first control means and second control means, said first control means serving for selectively guiding said first control butts onto said second raising portion or into said non-knitting track, and said second control means being disposed in a region of said second raising portion and serving for selectively leaving said first control butts on said second raising portion or guiding said first control butts into said tuck track, said patterning arrangement comprising a further cam member with a first drawing-down portion which acts on said operating butts and which is provided with a stitch-forming edge for establishing a drawing-down depth of said knitting implements; and a counter-cam member associated with said stitch-forming edge and having an inclined run-in portion, said run-in portion being designed for gently catching said operating butts of said knitting implements which are guided by one of the two drawing-down portion.

18. A knitting machine as defined in claim 17, wherein said second drawing-down portion has an end at which said defining member has an inclined run-off portion arranged in a region of said inclined run-in portion and guiding said second control butts of said knitting implements which are guided into the non-knitting track and into the tuck track, in such a way that the associated operating butts impinge gently against said drawing-down portion or said stitch-forming edge.

19. A knitting machine as defined in claim 17, wherein said knitting implements selected for non-knitting are positively guided as far as an end of said separating cam member with their operating butts between said cam member and said defining member and thereafter with their operating butts positively on a top side of said defining member and with their second control butts at the bottom edge of said defining member.

20. A knitting machine as defined in claim 18, wherein said knitting implements selected for non-knitting are positively guided as far as an end of said separating cam member with their operating butts between said cam member and said defining member and thereafter with their operating butts positively on a subsequent counter-cam member and with their second control butts at the bottom edge of said defining member.

21. A knitting machine, comprising a bed; a plurality of knitting implements mounted displaceably in said bed and each having at least one operating butt and at least one first movable control butt; and a pattering arrangement for being passed by said knitting implements and including a cam and selector means, said cam including cam members defining respective knitting, tuck and non-knitting tracks for each of said operating and control butts, said tracks being disposed in superposed relationship and containing a first tuck track cooperating with said operating butts and having a first raising portion leading into a tuck position and a first knitting track cooperating with said first control butts, having a second raising portion leading into a knitting position and being substantially parallel to said first raising portion, said selector means including first control means and second control means, said first control means serving for selectively guiding said first control butts onto said second raising portion or into said non-knitting track, and said second control means being disposed in a region of said second raising portion and serving for selectively leaving said first control butts on said second raising portion or guiding said first control butts into said tuck track, said patterning arrangement comprising a further cam member with a first drawing-down portion which acts on said opening butts and which is provided with a stitch-forming edge for establishing a drawing-down depth of said knitting implements, said defining member having a positioning cam which is arranged at an end of said separating cam member and which pivots said second control butts back and thereby pivots said first control butts forward, another of said cam members which extends parallel to said drawing-down portion and which acts on said first control butts having a top side provided with a recess disposed in the region of said positioning cam, and during a drawing-down phase said knitting implements which are raised into a tuck position being positively guided until they leave said positioning cam with their operating butts between said drawing-down portion and said separating cam member and after leaving said positioning cam they are positively guided with their operating butts at said drawing-down portion and with their first control butts at said top side.

* * * * *